US005165801A

United States Patent [19]

Stenström et al.

[11] Patent Number: 5,165,801

[45] Date of Patent: Nov. 24, 1992

[54] PACKAGE

[75] Inventors: Lennart A. Stenström, Trosa; Lennart Wahlström, Tumba, both of Sweden

[73] Assignee: AB Akerlund & Rausing, Sweden

[21] Appl. No.: 783,359

[22] Filed: Oct. 28, 1991

Related U.S. Application Data

[60] Division of Ser. No. 402,819, Sep. 5, 1989, Pat. No. 5,096,306, which is a continuation of Ser. No. 310,844, Feb. 14, 1989, abandoned.

[30] Foreign Application Priority Data

Feb. 15, 1988 [SE] Sweden ..... 8800494

[51] Int. Cl.[5] ..... B65D 33/02

[52] U.S. Cl. ..... 383/119; 220/403; 220/462

[58] Field of Search ..... 220/401, 403, 404, 405, 220/416, 441, 462, 463, 408, 410; 383/119, 104

[56] References Cited

U.S. PATENT DOCUMENTS

| | | | |
|---|---|---|---|
| 1,240,945 | 9/1917 | Clemens et al. | 220/404 X |
| 2,446,308 | 8/1948 | Smith | 220/463 |
| 2,666,710 | 1/1954 | Peters | 220/405 X |
| 2,749,245 | 6/1956 | Peters | 220/441 X |
| 2,951,628 | 9/1960 | Grussen | 383/119 |
| 3,112,047 | 11/1963 | Weinreich et al. | 270/403 X |
| 3,194,471 | 7/1965 | Murphy | 220/416 |
| 3,272,423 | 9/1966 | Bjarno | 383/119 |
| 3,326,364 | 6/1967 | Waldrop et al. | 220/416 |
| 3,339,721 | 9/1967 | Goldstein | 383/119 |
| 3,352,472 | 11/1967 | Cummings et al. | 220/462 |
| 3,542,566 | 11/1970 | Wakefield | 383/119 |
| 3,640,381 | 2/1972 | Kanada et al. | 383/119 |
| 3,643,854 | 2/1972 | Holmes | 220/462 |
| 3,684,155 | 8/1972 | Smith | 220/404 |
| 3,756,495 | 9/1973 | Bemiss | 220/462 X |
| 3,863,830 | 2/1975 | Christensson | 220/462 X |
| 4,141,466 | 2/1979 | Gordon et al. | 220/462 |
| 4,478,351 | 10/1984 | Homma | 220/462 |
| 4,533,065 | 8/1985 | Chazal et al. | 220/462 |
| 4,679,701 | 7/1987 | Ackermann et al. | 383/119 |
| 4,722,474 | 2/1988 | Dropsy | 220/462 X |
| 4,801,017 | 1/1989 | Artusi | 220/405 X |

FOREIGN PATENT DOCUMENTS

| | | | |
|---|---|---|---|
| 14599 | of 1904 | United Kingdom | 220/65 |

*Primary Examiner*—Gary E. Elkins

*Attorney, Agent, or Firm*—Lerner, David, Littenberg, Krumholz & Mentlik

[57] ABSTRACT

A package is disclosed comprising two members formed together. One of the members is a closed member of cardboard or a corresponding material, and the other member is flexible. The rigidifying member has a closed peripheral portion, and a completely covering bottom which is continuous with the peripheral portion. The flexible member is fastened along its entire periphery at sufficient points on the outer member such that the package has a stable shape.

3 Claims, 9 Drawing Sheets

PACKAGE

CROSS-REFERENCE TO RELATED APPLICATIONS

This is a division of application Ser. No. 07/402,819, filed Sept. 5, 1989, U.S. Pat. No. 5,096,306, which is a continuation of Ser. No. 07/310,844, filed on Feb. 14, 1989, abandoned.

FIELD OF THE INVENTION

The present invention relates to a package which is make up of two members formed together. More particularly, the present invention relates to such a package in which one of the members is a closed flexible member containing a filling or product, and the other member is an outer member of cardboard or corresponding material.

In a first embodiment, the outer member, in a raised state, forms a tray.

The flexible member may, for example, be a sheet-shaped element of paper, plastic or metal, or a combination of the said materials. Said flexible member can however also be a flexible container such as a bag.

In a second embodiment, the outer member is a frame of cardboard or a corresponding material.

BACKGROUND OF THE INVENTION

There has been a continuing need for a packaging technique which is environmentally safe, and which also uses few resources so as to realize an extreme saving in terms of materials.

The problem which has been solved by the present invention is thus to provide a package which employs flexible material and an outer member, and in which they cooperate to provide a packaging construction which is strong, has an appearance which is well adapted to the purpose, and is comfortable to handle. In the case where the outer member is a frame, it is also desired that the consumption of materials be minimal.

The combination of flexible material and stiff material is a well-known packaging concept. There is, for example, the bag-in-box technique, where a plastic bag is contained in an outer package such as, for example, of the folding box type. This technique uses a great amount of material, and is perhaps basically motivated by the fact that cardboard is traditionally considered to be that material which sells the product, because of its ability to bear pressure and to be decorated However, the ability of the outer cardboard to stand stably is not especially good. One thus often finds that an arched or outwardly convex surface, which is produced by means by which it has been filled, by handling, etc, is the surface which is ultimately intended to serve as the standing surface.

Because of its lengthwise sealed parallelogram structure, an outer package in the shape ,of a so-called folding box has only moderate resistance to diagonally acting forces. The folding box, therefore, collapses rather easily under a load.

In addition to the conventional cardboard and capsule techniques, there are also a large number of other techniques which in one way or another utilize a combination of flexible material and stiff material such as cardboard.

For example, Swedish Patent No. 432,576 shows a flexible package having a wrapper made of cardboard. This wrapper has a significant width and is placed along the broad sides of the flexible package. When using the wrapper, the package is made resistant to pressure by folding down laterally sealed tins of the flexible package towards the outside, and by allowing pressure to press these downwardly folded tins towards the pressure-bearing wrapper.

A combination of a bag and a stiffer wrapper is also shown in U.S. Pat. No. 327,243.

Furthermore, in German Patent No. 22 15 350 it is shown how to make a plastic bag standable by fastening a strip having a profile roughly corresponding to the shape of sigma or W to its bottom.

OBJECTS OF THE INVENTION

It is the purpose of the present invention to further improve the combination technique in order to provide a finished package which is shape stable, and to also provide for the full authorization of the material saving effect in a great number of applications.

SUMMARY OF THE INVENTION

In accordance with the present invention, these and other objects have now been realized by the invention of package which includes an outer rigidifying member having a closed peripheral portion and a bottom which is continuous with that peripheral portion, and an inner flexible member, the flexible member having an outer periphery which is closed for carrying a filling product and which is fastened along that outer periphery to the peripheral portion of the outer rigidifying member so that the package has a stable shape. In a preferred embodiment, the outer rigidifying member is in the form of a tray. In accordance with this aspect of the present invention, methods for manufacturing a package are also provided which include providing an outer rigidifying member which is closed about its periphery and which includes a bottom, providing an inner flexible member, filling and closing the inner flexible member, and joining the inner flexible member to the outer rigidifying member along the periphery of the outer rigidifying member so that a shape-stable package is provided. In a preferred embodiment the method includes subjecting the flexible member to a treatment which would damage or destroy the outer member prior to joining the inner flexible member to the outer rigidifying member.

In accordance with this application an invention is also disclosed which includes a package comprising a flexible member joined to a frame member having an outer closed periphery including a plurality of corners and defining a plane between the plurality of corners, the frame member further including a first end and a second end and having a profile between the first and second ends which is non-linear and which includes a first portion extending in a first direction substantially perpendicular to the plane defined by the frame member and a second portion extending in a second direction substantially opposite to the first direction, the first and second portions being separated by a plurality of corners whereby the package has a stable shape. In accordance with one aspect of this invention the first and second ends of the frame member include lip portions extending essentially perpendicular to the plane defined by the frame member.

According to another aspect of the present invention an alternative is provided to traditional cardboard packages such as trays as is an arrangement for handling thin-walled packages, that is, packages which are otherwise difficult to master and are made of flexible packaging materials. In accordance with this invention, there is thus provided a package which has two members joined together, one of which is a closed flexible member containing a filling or product, and the other of which is an outer member of rigidifying material such as cardboard or corresponding material thereto.

According to a first aspect of the present invention, the package is characterized by the outer member being closed about its periphery and having a wholly covering bottom portion which is continuous with the peripheral portion, and by a flexible member which is fastened along its entire periphery at at least enough points on the outer member so that the package will have a stable shape.

In one embodiment the outer member, in a raised state, forms a tray.

When in a flat state the outer member is preferably one which can be decorated. Furthermore, it is fastened onto a filled flexible package which, along with it contents, has preferably been previously subjected to a treatment, such as heat treatment, which would have been destructive to the outer member.

Since the flexible member normally consist of a barrier-specific material, and normally one which provides high barrier properties, such as a plastic material, which is, therefore, expensive, the amount of this material being employed can be dimensioned, with a view only to its barrier characteristics, whereas the outer member, normally of the inexpensive cardboard material, is employed for the purpose of establishing the shape stability of the package.

According to a second aspect to the present invention, the package provided comprises two joined members, one of which is flexible and the other of which is a frame member of cardboard or the like.

According to this second aspect, the characteristics of the package are such that the frame is closed, that the frame has a profile which is terminated with a first outer member and a second outer member, and in which the profile is non-linear between these first and second outer members. Furthermore, as seen in the direction of the circumference of the frame, the package has portions which extend outward and inward relative to the package and in which the transition between these two portions is located at the corners of the package, and the profile, as seen in a circumferential direction of the frame, has a shape which on one side of a corner is mirror reversed relative to that shape on the other side of that corner, and the flexible member is fastened to at least enough portions of the frame such that its deformation, as viewed in a direction perpendicular to the plane of the frame, is restrained by the flexible member.

Depending upon the desired application for this package, one or both of the first and second outer members may comprise a lip.

In one embodiment the frame has a mainly sawtooth-shaped profile provided, which may be provided with a lip so that on one side of the frame corner the profile turns its lips inwards into the package, while on the other side of the same corner it turns it lips outward from the corner.

In another embodiment the profile between these lips is zigzag shaped.

According to an additional embodiment, the profile between these lips or outer members is rounded or arcuate in shape.

In order to provide a frame with a non-linear profile, in one embodiment the frame has corner folds or the like in a zigzag pattern transverse to its longitudinal direction in order to form the corners, in addition to which it includes longitudinal folds which proceed from each of the zigzag folds, and each of these longitudinally-extending folds changes its characteristics at each such zigzag fold, so that a fold made from one side of the frame material changes into a fold made from the other side of the frame material at that point. Because of the shape of the frame, which is itself very rigid, it now gains a high buckling strength and load-bearing ability at its corners. Because the frame is closed it, therefore, also becomes very torsionally stiff, despite the fact that it is built up with profiles which do not have a significant torsional stiffness of their own. In one embodiment the nonlinear profile thus provides frame surfaces for securing the flexible member.

In one embodiment the flexible member comprises a sheet portion, which is secured to the frame at a location such that a box is formed in which the sheet comprises the bottom of the box and the frame comprises its sides.

In an additional embodiment, the flexible member also includes a second sheet portion which is secured to the frame at a position such that the second sheet portion forms a lid for the box.

In an additional embodiment, the flexible member is a thin-walled, deep-drawn tray package with a heat-sealed lid, which includes sealing lips symmetrically secured to the frame, for example, the lips of a frame provided with lips, or the non-linear portion itself, at both the lips and the said member.

In another embodiment the flexible member is a closed plastic bag, which is fastened to the profiled frame at sufficient points such that the resulting packing becomes rigid. If the plastic bag is provided with a spout in one corner, and a recess in an adjacent corner, a package is achieved which stands securely and which has a handle, which is comfortable to pour out of and also has the characteristics of a pitcher. In this example, the securing of the plastic bag is asymmetric. This package can also be resealed by the spout being folded around one of the lips of the frame, which is provided with lips, and which is locked in this position by being inserted into a slot in the frame.

In another such embodiment the package is suitable for, e.g., infusion solutions. In operation the spout is turned downward and the package is hung from a corresponding corner of the frame. The securing of the plastic bag in this case can be either symmetric or asymmetric. In the embodiment where the flexible member is simply a sheet or foil, if this is fastened to the lips of the frame, or to the nonlinear portion of the profile between its first and second outer members, a stable and cheap box or carton is provided. Further, if the sheet is fastened to the opposite end portion of the non-linear profile member, or to the opposite lip, one obtains a lid for this package. The bottom or lid of the box can be of an air-permeable material, such as a so-called non-woven material or a net. In the latter case, it is advantageous for the threads of the net to form an angle with the sides of the frame in order to maintain the rigid shape of the package. Where one uses a sigma shape as the starting point for the profile of the frame, it does not necessarily have to be a simple sigma. In the alternative, the frame may consist of two or more "sigmas" placed one upon the other, whereby the profile takes up less space in the plane of the package.

The invention also provides a method for manufacturing a shape-stable package comprising two joined members, one being flexible and the other being an outer member of cardboard or the like.

An important characteristic of the invention is that a closed member containing filling which forms the flexible member is fastened to the outer member, which is closed along its periphery, and the flexible member is fastened to sufficient portions of the outer member that a shape-stable package is achieved.

In one embodiment the flexible member with filling is subjected to a certain treatment, such as a heat treatment, which is destructive to the outer member before it is fastened to the outer member.

The outer member can, for example, be chosen as a work piece which may be raised to form a tray, and which may me decorated in advance. The inner member is suitably secured to lips on the tray.

According to a further aspect of the invention, a method for manufacturing a shape-stable package is provided comprising two joined members, one being flexible and the other being an outer member of cardboard or a corresponding material. A characteristic of this method is that the outer member is chosen as a peripherally connected frame, which has a stiffening design.

DESCRIPTION OF SPECIFIC EMBODIMENTS

Figure 1:
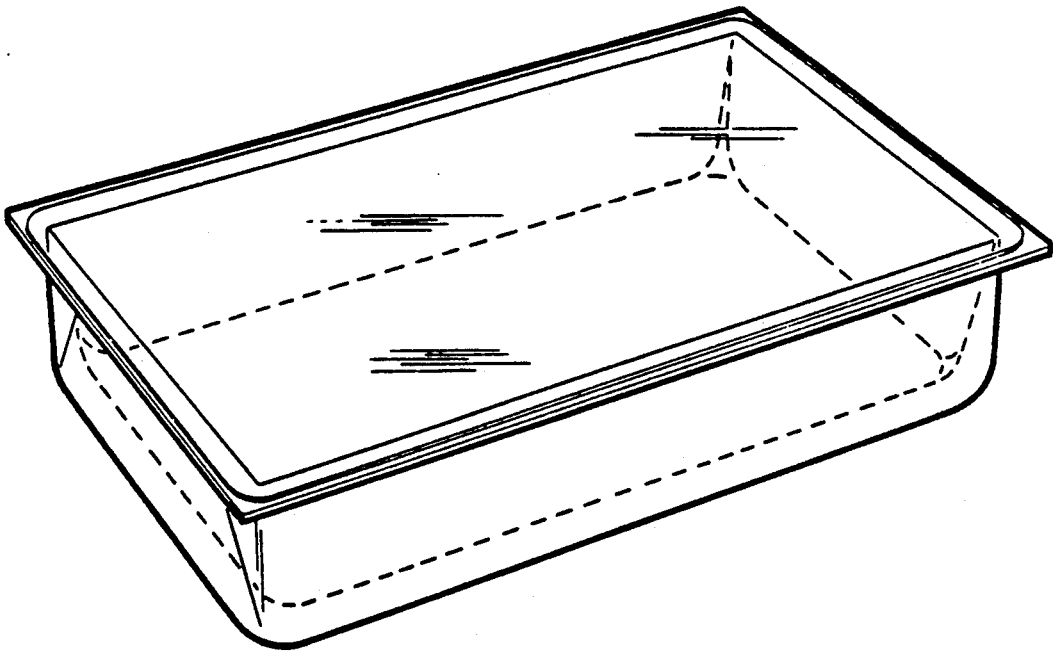
FIG. 1 is a perspective view of a package comprising a closed inner member containing a filling material and an outer member in the shape of a tray.

Referring to the Figures, in which like reference numerals refer to like portions thereof, FIG. 1 shows a traditional cardboard tray provided with a lip. A closed flexible package of, e.g., a high barrier plastic material containing filling, is carried in this tray. The plastic container or bag is fastened to the lips of the tray in sufficient portions or positions such that a shape-stable unit is achieved. The lips or flange in FIG. 1 is directed inwards, but such flanges directed outwards are also possible. Additionally, one or both pairs of the side walls may have a beam-shaped structure.

The form stability of the unit shown in FIG. 1, comprising the outer tray and inner bag is, therefore, determined by the inexpensive cardboard material of the outer tray. The barrier characteristics are determined completely by the plastic material of the inner bag, so that the cost may be optimized since the more expensive plastic material need only be dimensioned for barrier protection and not for the purpose of attaining shape stability.

Since the product in the plastic package will usually be subjected to heat treatment of a level which the cardboard could not withstand, the cardboard material is fastened to the plastic package only after termination of the heat treatment. This is also an optional choice from the viewpoint of the overall process.

Figure 2:
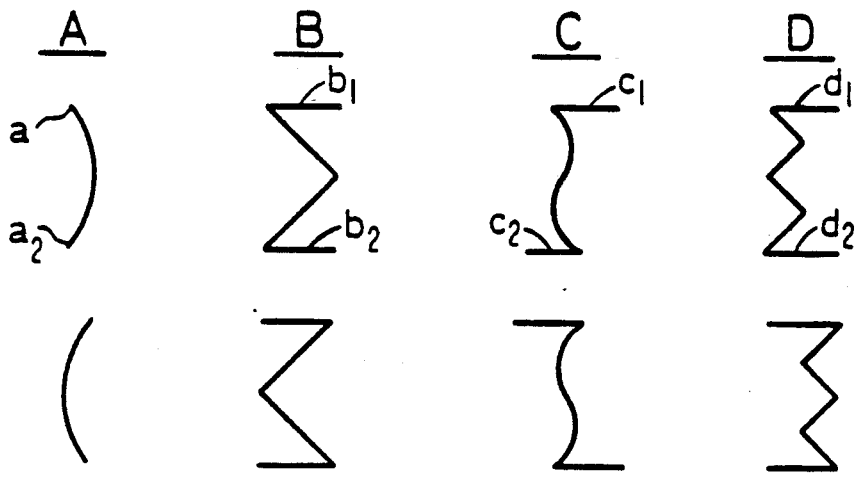
FIGS. 2A, B, C and D are side, sectional views of different frame profiles for a preferred embodiment of the present invention.

Using the designation a, FIG. 2 shows first basic shapes of non-linear profiles for the frame member, more particularly as viewed from the left, one concave profile and one convex profile. The designation b indicates two different basic shapes of profiles provided with lips, one in the shape of a sigma, and the other in the shape of a mirror reversed sigma. The designation c indicates additional examples of profiles provided with lips, where the non-linear profile member has lips as in case b. The designation d indicates two "double sigma" or "double zigzag" profiles provided with lips.

Figure 3:
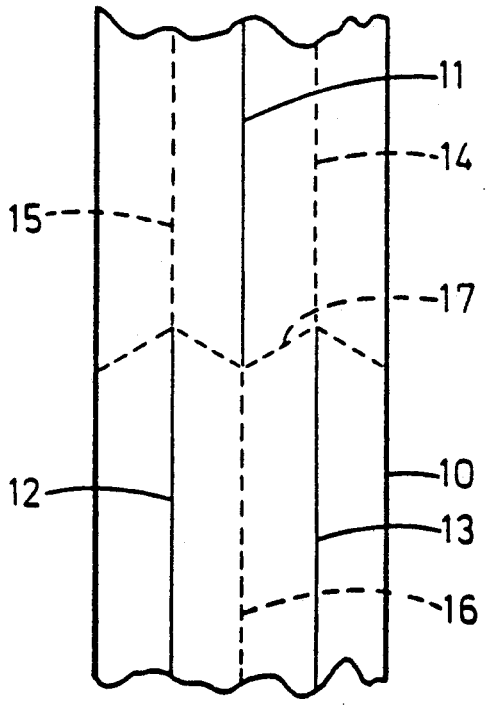
FIG. 3 is an elevational, partial, planar view of a portion of a strip intended to constitute a frame material according to the present invention.

The strip 10 shown in FIG. 3 is a strip of cardboard or a corresponding material. The solid lines 11, 12 and 13 indicate fold lines or other similar weakened areas, which are applied to the strip material in the upward-turned side according to FIG. 1. The dashed lines 14, 15, 16 and 17 indicate fold lines or the like made in the other side of the strip.

Figure 4:
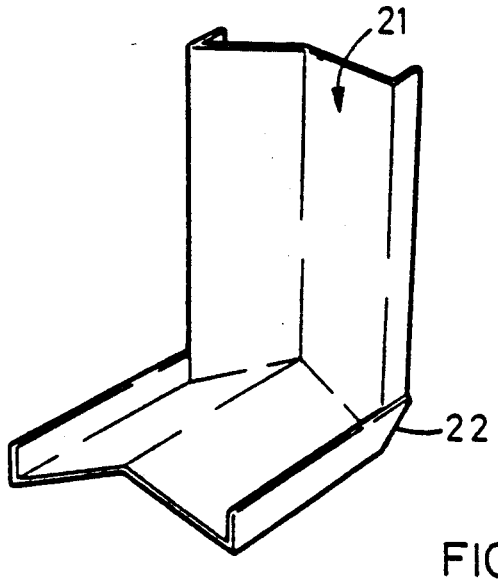
FIG. 4 is a perspective view of an inside corner formed from the frame material shown in FIG. 3.

The zigzag line defines the limited lines which determine the corner configuration when a frame is formed according to FIG. 4, which shows the inside of such a corner. The profile which is indicated in FIG. 4, and which is principal comprises portions forming a capital sigma, or a mirror reversed sigma or W (depending on which side of the corner one views the frame from), has proven to provide high bending and torsional rigidity for a closed frame.

Figure 5:
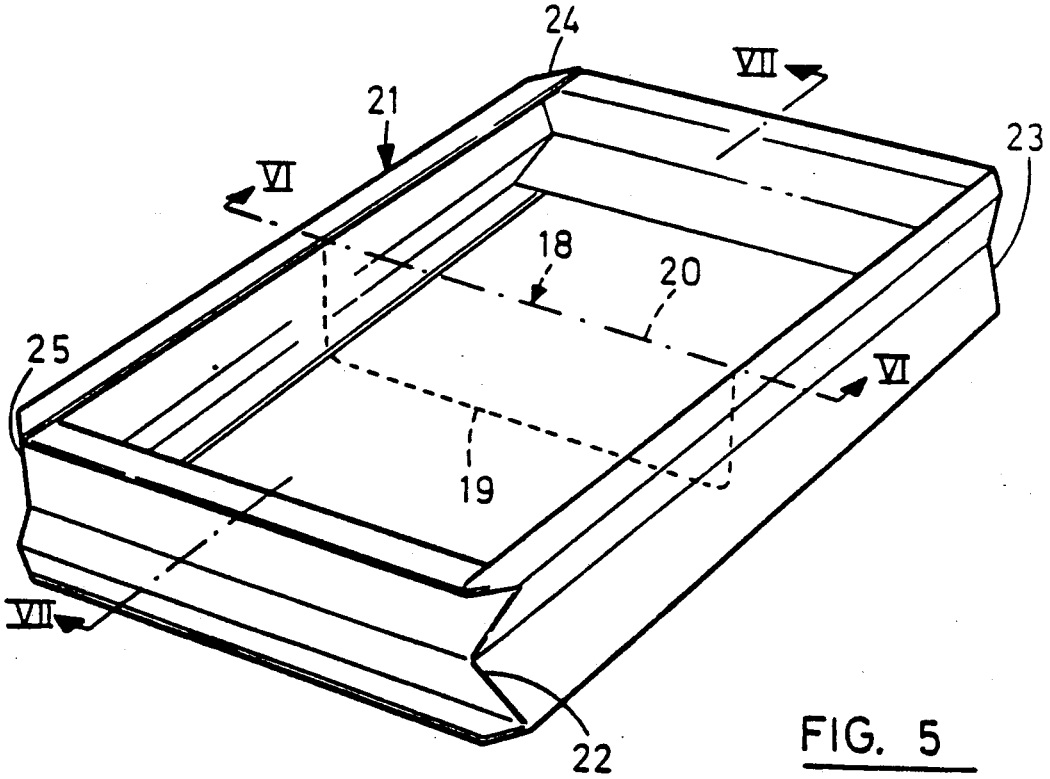
FIG. 5 is a perspective view of a thin- c walled package of the tray-type enclosed by an enclosing frame.
Figure 6:
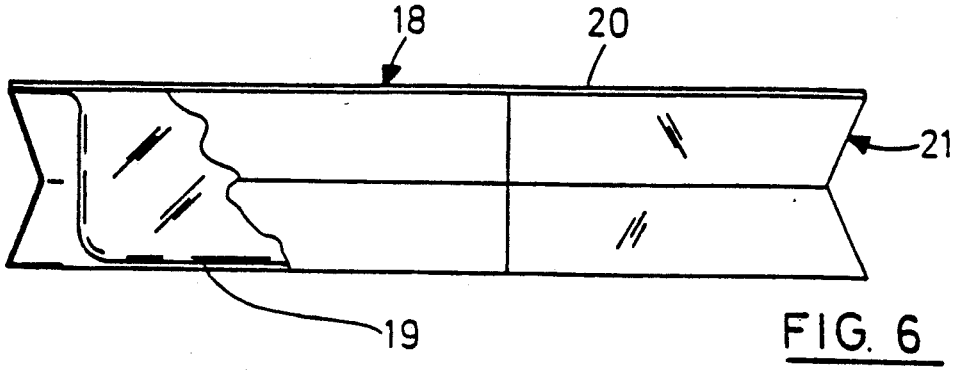
FIGS. 6 and 7 are perpendicular, partially sectional views taken along lines V—V and VI—VI, respectively, in FIG. 4, showing an alternative for insertion and securing of the thin-walled plastic package hereof in the frame.
Figure 7:
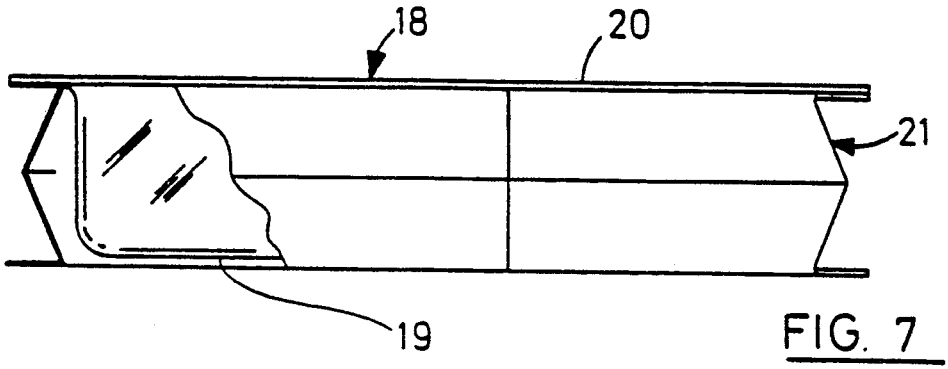

This makes the frame especially suitable as a stiffening rim for a package 18 of the tray-type, comprising a bottom portion 19 and a lid 20 (see FIGS. 5–7). Such trays are very stable, especially when filled, and with respect to shearing forces in the plane of the lid or planes parallel thereto, but the strength thereof is insufficient with regard to bending and turning about axes in that plane.

The encompassing frame 21 shown in FIGS. 5–7 provides the needed strength in this respect, and also provides a package which is easy to handle, and which also has good standing characteristics.

The enclosing frame 21 in FIGS. 4–7 is sealed or fastened to the tray in accordance with the invention so that the flexible member, in the present case the tray provided with a lid, is fastened to enough portions of the frame 21 such that its deformation, viewed perpendicularly to the frame, is prevented by the flexible member.

As will be seen by comparing FIG. 6 and 7, the "non-linear member" of the profile in this case has a "W-characteristic" from the one side of the corner to the other side. Viewed in the direction of the circumference, the frame generally has portions which extend outward and inward relative to the package in the frame, and the transition portions 22, 23, 24 and 25 between such portions are located at the corners.

In the exemplifying embodiment shown in FIGS. 6 and 7, the frame is provided with lips, and the flexible "inner package" is fastened to the upper sides of the lips of the zigzag-shaped profile, which thus changes the orientation relative to the inner package in these corner regions.

Figure 8:
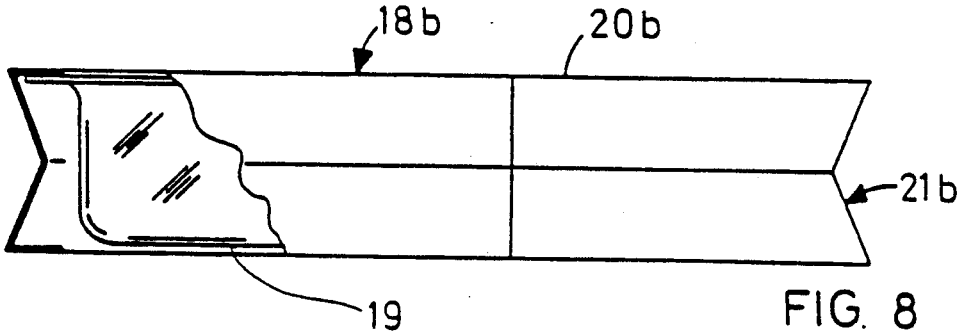
FIG. 8 is a partially sectional view of a third alternative for such insertion and securing.
Figure 9:
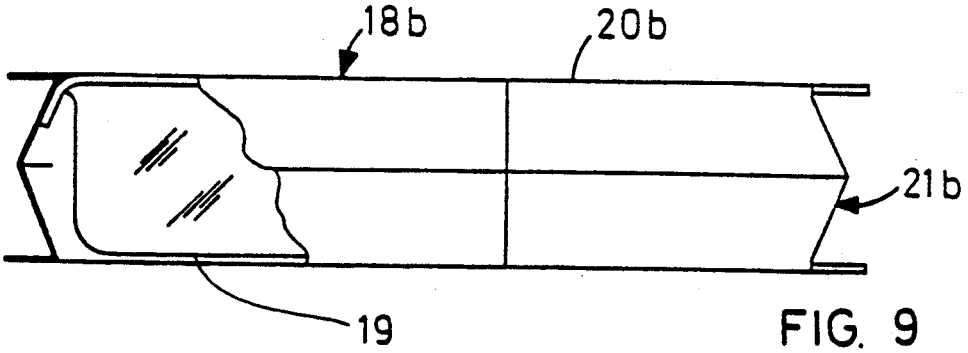
FIG. 9 is a partially sectional view of a fourth alternative for such insertion and securing.

In FIGS. 8 and 9 there are shown other possibilities for fastening which is done so that the deformation of the frame, viewed in the direction perpendicular to the plane of the frame, is prevented by the flexible member, and the "inner container," comprising a tray member 19*a* and a lid 20*a*, is fastened to the lips of the frame 21*a*, in this case to the underside of the lip on the one side of the corner and to the upper side on the opposite side of the corner. As in FIGS. 6 and 7, it is fastened to sufficient points of the enclosing frame or its lips such that the deformation of the frame viewed in a direction perpendicular to the plane of the frame is prevented by the flexible member. Fastening may, for example, be done by using pointwise-applied melting glue, or by heat sealing all the way around, using a thermoplastic material.

Figure 10:
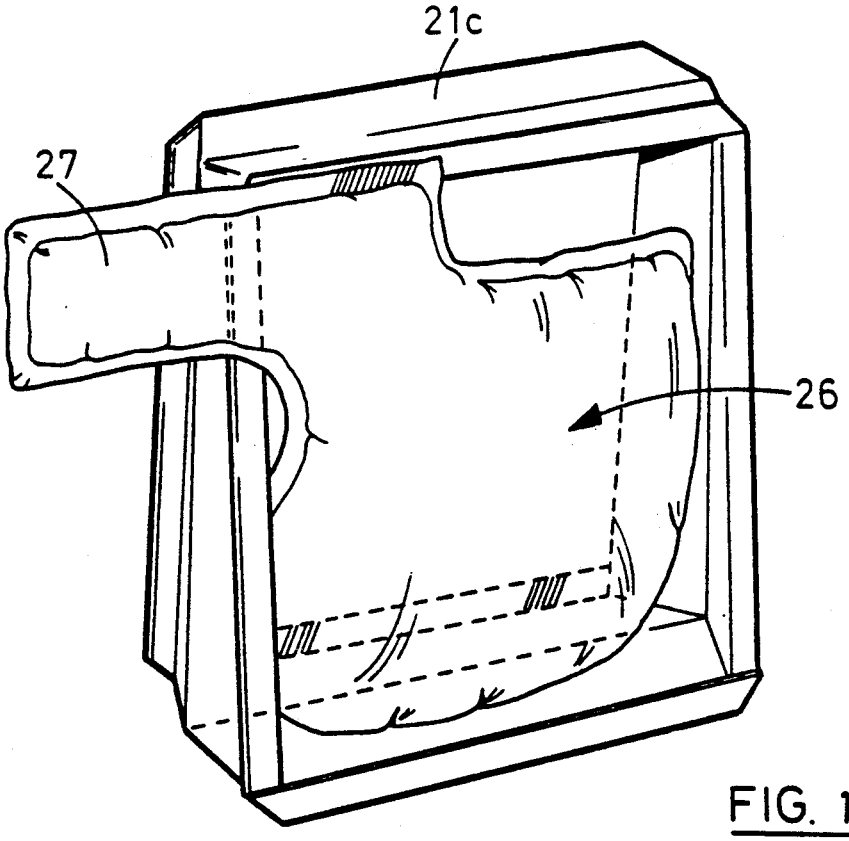
FIG. 10 is a perspective view of a package having the function of pitcher formed from a flexible bag fastened to a frame of the sigma-profile type.
Figure 11:
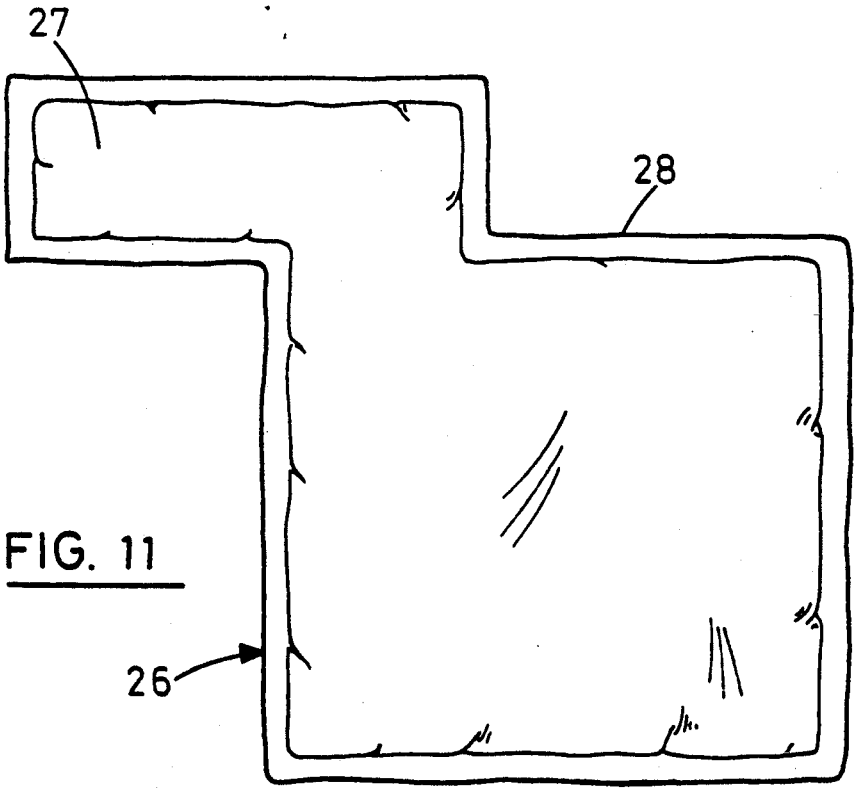
FIG. 11 is an elevational view of the bag of FIG. 10.

In FIGS. 10 and 11 there is shown an additional case where an enclosing frame 21*c* is utilized, together with a flexible inner package having a lid and tray. Instead of fastening the encompassing boarder lip of the flexible package to the frame lip all the way around the frame, in this case the opposing sides of the "non-linear member" of the profile are fastened, i.e., in the W-shaped member of the zigzag-shaped or the sigma-shaped profile. Even in this case one guaranties that the fastening will be sufficient for the flexible member to provide the frame with the ability to resist deformation in a direction perpendicular to the plane of the frame.

Instead of the zigzag profile according to the FIGS. 6–11, one may also envision a profile shape according to a, c or d in FIG. 1. A package having a frame with profile d is shown in perspective in FIG. 17.

In FIG. 10 a frame 21*c* supports a bag 26 according to FIG. 11. This bag 26 is of the type which is manufactured to be spill free by means of welding and punching through webs of flexible material, or a lengthwise sealed tube.

Figure 12:
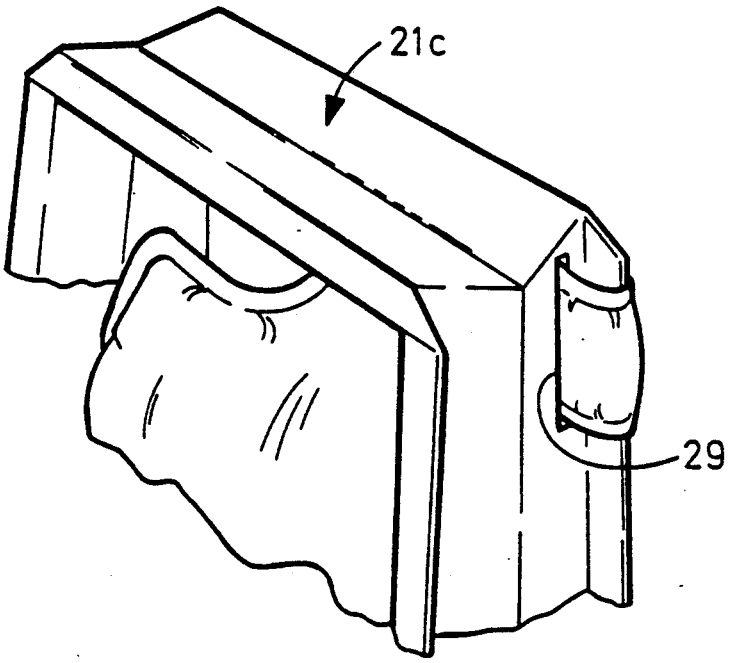
FIG. 12 is a partial, perspective view of a suitable position for the spout of the bag shown in FIG. 12 during transport of the package according to FIG. 10, as well as in a reclosed state.

The bag has two characteristic members, namely a pouring spout 27 and a recess 28, which corresponds to the spout. The recess leaves an open space for inserting a finger between the bag and the frame after the bag has been hung in the frame. By punching out or by some other method providing a slit 29 in the frame 21*c* (see FIG. 12), one makes it possible to reclose the bag 26.

Figure 13:
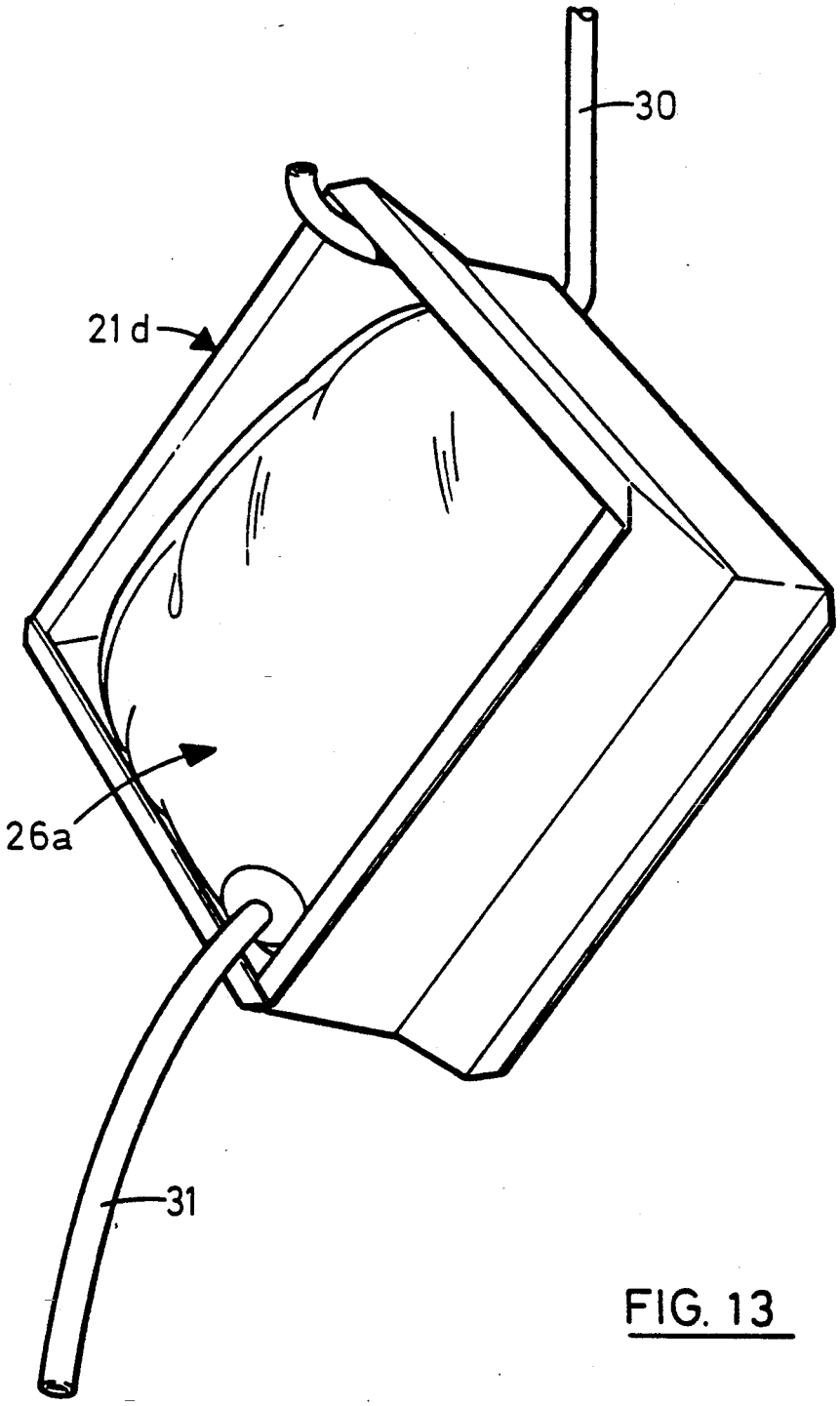
FIG. 13 is a perspective view of a package for, e.g., infusion fluids, formed of a flexible bag provided with a spout and fastened in a Z-profile frame, and hung with a corner of its frame hooked on a hook.

FIG. 13 shows how the free space between a bag 26*a* and a frame 21*d* can be used to hang the package on a hook 30. In this case, there may, for example, be some kind of nutrient solution in the bag 26*a* for delivery of the solution to a patient. For such a purpose, the bag 26*a* is provided with a drainage tube 31.

Figure 14:
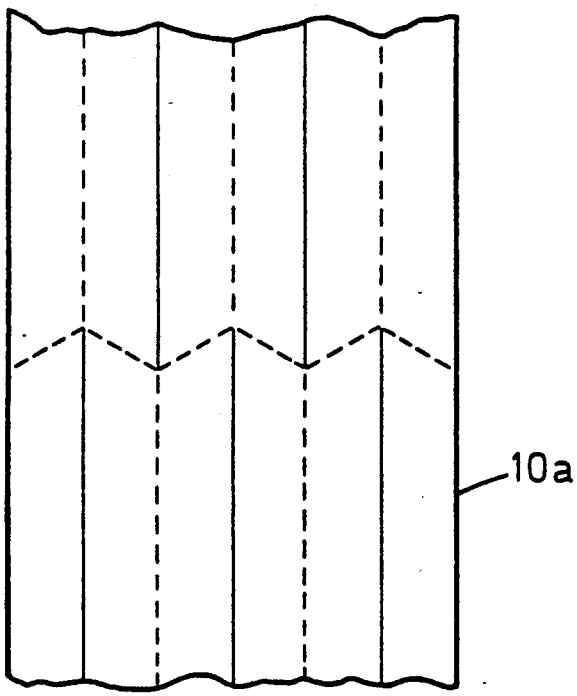
FIG. 14 is a partial, planar view of a portion of a strip intended to provide a double frame according to the invention.
Figure 15:
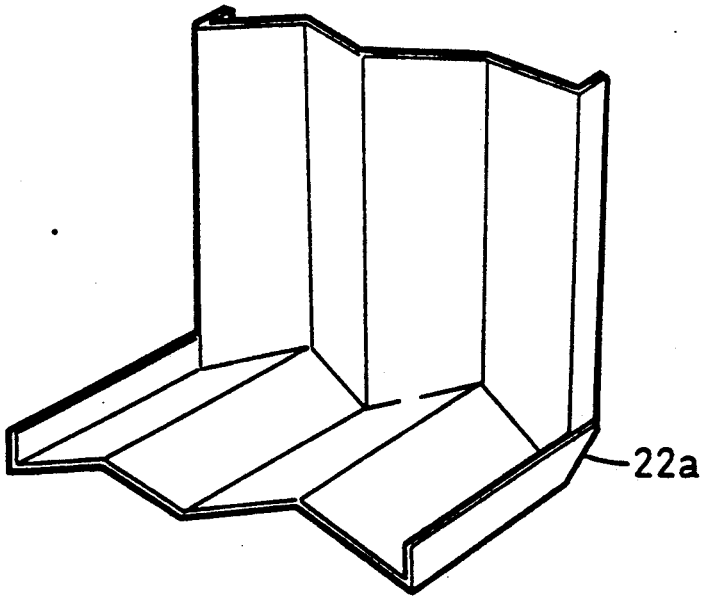
FIG. 15 is a perspective view of the inside of a corner manufactured from the material of FIG. 14.

FIG. 14 shows a strip-shaped material 10*a* for a "double zigzag profile," with one corner 22*a* being shown from the inside of the frame.

Figure 16:
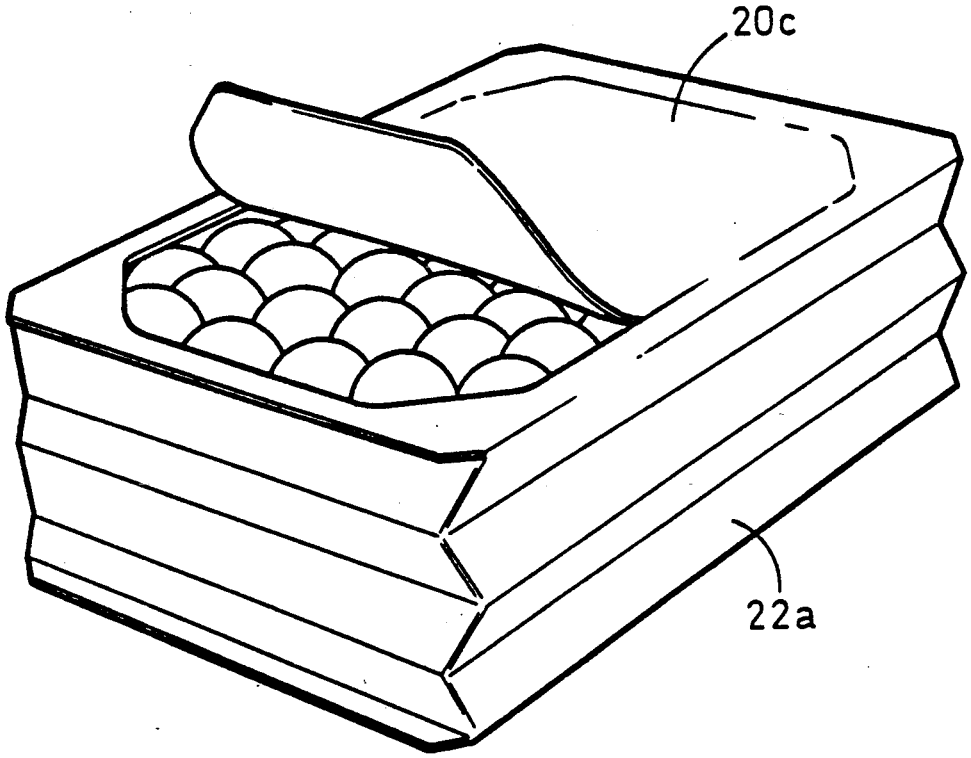
FIG. 16 is a perspective view of a complete package comprising an inner tray and a frame manufactured of the material in FIG. 14.

FIG. 16 shows a frame manufactured from the material shown in FIG. 14, together with an upper, flexible, sheet-shaped element 20*c*, which can be opened. A corresponding sheet-shaped element is fastened to the lower encircling lid in the frame, and serves as a bottom for the package in FIG. 8.

FIG. 16 thus shows a product-containing tray formed from a frame 22*c* made of the strip in FIG. 14 and a thin top closure 20*c*, as well as a bottom closure of similar type.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A package comprising a frame member formed from a sheet material and a flexible bag joined to said frame member, said frame member having an outer closed periphery which is non-linear in cross-section, said outer closed periphery having a plurality of corners which together define an imaginary plane, said plurality of corners being defined by a first portion extending in a first direction transverse to said plane and a second portion extending in a second direction substantially opposite to said first direction.

2. The package of claim 1 wherein said bag includes a spout portion extending beyond said frame member, said frame member including a recess whereby said spout portion can be reclosably locked within said recess.

3. The package of claim 1 or 2 wherein a space is provided in at least one of said plurality of corners of said frame member between said frame member and said flexible member whereby a hanging device can be inserted into said space for hanging said package therefrom.

* * * * *